United States Patent [19]

Borda

[11] Patent Number: 4,662,200

[45] Date of Patent: May 5, 1987

[54] COMBINATION KEY

[76] Inventor: Rafael U. Borda, Casa Gure-Pakea, Barrio Ayete, San Sebastián, Spain

[21] Appl. No.: 772,752

[22] Filed: Sep. 5, 1985

[30] Foreign Application Priority Data

Oct. 15, 1984 [ES] Spain ..... 281963
May 27, 1985 [ES] Spain ..... 287095

[51] Int. Cl.[4] ..... E05B 19/08; E05B 19/18

[52] U.S. Cl. ..... 70/411; 70/395; 70/398

[58] Field of Search ..... 70/411, 409, 395, 397, 70/398

[56] References Cited

U.S. PATENT DOCUMENTS 146,468 1/1874 Munger ..... 70/397
639,599 12/1899 Mosler ..... 70/411
828,480 8/1906 Ibbott ..... 70/411
939,679 11/1909 Freud ..... 70/411
4,545,226 10/1985 Urrestariazu-Borda ..... 70/411

*Primary Examiner*—Robert L. Wolfe
*Attorney, Agent, or Firm*—Toren, McGeady and Goldberg

[57] ABSTRACT

A combination key includes a hollow head, a hollow stem connected to the head and a plurality of teeth mounted on racks longitudinally movable in the head and stem. The racks are in meshed engagement with toothed control wheels which are mounted in the head and emerge partially to the outside. The control wheels are located in the head next adjacent the stem. The length of the head is at least equal to the length of the stem so that the racks can be accommodated in the head when the teeth are in a position of maximum retraction.

5 Claims, 7 Drawing Figures

COMBINATION KEY

BACKGROUND OF THE INVENTION

1. Field of the Invention

The present invention relates to improvements in a combination key which permits the opening of various different locks with a single key.

2. Description of the Prior Art

Most conventional locks have a tumbler which is normally blocked and must be turned for opening. The tumbler is blocked by means of a key. More specifically, the tumbler has a lower structure with levers which must assume specific positions for the unblocking to occur, which positions are determined by the introduction of the key and through the appropriate contours on the operative edge or edges of the key. The turning of the tumbler may cause the taking along of the ward directly or may establish an electric circuit. This causes the actual opening without affecting the structure of the operative lock-key assembly.

Today's lifestyle require that often a certain person must carry a considerable number of keys to have access to different dwellings provided with corresponding locks. The ideal solution would be to have a single key for opening all locks, but it is clear that such a solution is not feasible because, unless all locks are installed at the same time, so that they can easily be identical, it would be very difficult and costly to later obtain one or more locks that would fit a certain key. On the other hand, losing the one and only key would, under certain circumstances, make it necessary to change all the locks which also would be a considerable economic problem.

The applicant is the owner of a recently granted U.S. Pat. No. 4,545,226 (application Ser. No. 566,523 of Dec. 29, 1983), relating to a combination key which overcomes these problems by permitting the use of a common key for different locks without crating a problem by the loss of the key since, without knowing its concrete combination, the key cannot be used for opening any of the locks for which it is intended.

Specifically, the combination key disclosed in patent application Ser. No. 566,523 includes a stem capable of insertion in a wide spectrum of locks, just as a conventional key matrix is able to fit into different locks, the teeth which are to establish the specific combination for each case being cut from the matrix. In accordance with the present invention, the teeth are independent of the stem and displaceable along the latter to vary their position in accordance with different locks.

Thus, starting with a stem of a certain configuration common for all locks of the spectrum, on the stem are installed a series of teeth in variable number, which only with a certain positional combination will permit the opening of a certain lock, while in any other position they would be ineffective for the lock. To effect the opening of another lock, it will suffice to move the teeth until they occupy a different relative position, likewise in accordance with the lock which in this case is to be actuated by the key.

For the displacement of the teeth, the body of the key on which one acts in the manipulation of opening or closing, is provided with a series of control elements or wheels which act on respective transmission means for the displacement of the teeth or notches with which the combination of the key is established. The means for moving the teeth includes at least one chain disposed in the interior of the stem and extending into the actuating body, the teeth attached to the at least one chain, at least one control wheel disposed in the actuating body and in meshed engagement with the at least one chain.

Although such a solution would be suitable from the point of view of the purpose aimed at, the inventor has been able to observe that it would present the following disadvantages:

- It would be too complicated to make the key and its size would be far too big.
- It would be relatively difficult to achieve the correct relative positioning of the teeth in each case.
- Its manipulation would also be difficult because the very same insertion process of the key would bring about the tendency that the teeth would be displaced with regard to the original by established position, in spite of the step-by-step adjustment.

SUMMARY OF THE INVENTION

The invention is directed to overcome these problems. It has therefore been provided that racks are used as transmission means for the teeth, specifically one rack for each simple or multiple mobile tooth. Each one of these racks slides along the corresponding guide, appropriately arranged in the body of the key and each tooth is rigidly united to the corresponding racks, while each of these racks is directly related to the corresponding toothed actuating wheel. In accordance with the above mentioned points and with a preferred embodiment of the invention, the actuating head presents the same length, or is slightly longer than the teeth holding racks and the toothed actuating wheels of these racks are displaced to a maximum in the head of the key, towards the operative stem.

The toothing of each one of the heretofore mentioned racks is designed in harmony with the perimetral toothing of the actuating wheels, in order to guarantee a perfectly meshed engagement between these elements.

One or several racks can be incorporated in the key according to its different embodiments. More precisely speaking, it may have one single rack with one single wheel that can be actuated from one of the sides of the head of the key, or rather two wheels on one and the same side destined to act on respective racks. An identical structure can be repeated on the opposite side of the key in function of the number of movable teeth provided for the key, and therefore of the combination possibilities, which have practically no limit whatsoever, except for the dimensions established for the keyset in each case.

In accordance with another object of the present invention, two lateral flanges are furthermore incorporated in the head of the key which are extended up to the stem and laterally lined up to its initial area and which are to be inserted in respective slots of the tumbler, so that the turning stress to open a lock is transmitted from the key to the tumbler through the flanges, whereas neither the teeth nor the very same hollow stem are submitted to any stress.

In accordance with another object of the present invention, the combination key has an auxiliary mechanism to block the control elements of the teeth, once they would have been positioned appropriately according to the combination that corresponds to the lock, on which the key has to act.

For this purpose and besides the racks and toothed wheels, the key furthermore incorporates a "U" shaped slide whose lateral branches are spaced according to the separations existing among the control wheels. During the actuation of the key, these lateral branches of the "U" shaped slide are guided manually towards the periphery of the control wheels to be locked in their teeth, thereby causing the blocking.

On correctly guiding the middle section of said "U"-slide, it slides pressing on an inclined elastically retractile plane which is recovered, on being surpassed by the middle section of the "U"-slide, so determining its blocking and therefore the blocking of the control elements or wheels.

When the key has a pair of wheels on each side of its head, the blocking mechanism will be double (one on each side) and when it has more than two wheels arranged on one and the same side of the key, the "U" shaped piece will be substituted by another similar piece shaped like a comb, and consequently be equipped with a several legs or branches, as it would correspond to the number of wheels. These legs or branches are spaced apart in accordance with the separation between the wheels.

The various features of novelty which characterize the invention are pointed out with particularity in the claims annexed to and forming part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE PREFERRED EMBODIMENT

Figure 1:
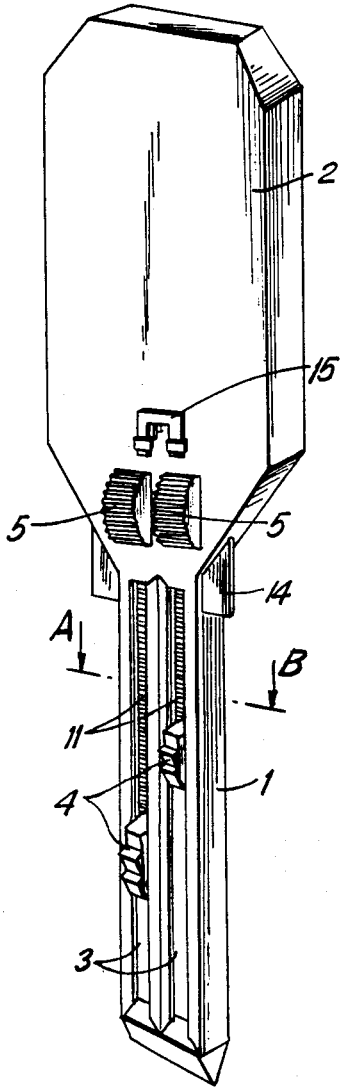
FIG. 1 is a general perspective view of a combination key in accordance with the present invention.

It can be seen from these figures that the key proposed by the present invention comprises a hollow body, in which a stem 1 is defined for its insertion into the tumbler of the lock, as well as an actuating head. The stem 1 is provided with longitudinal slots 3, from which the teeth 4 emerge to the outside; these teeth serve to establish the different adequate combinations which correspond to the different locks that can be opened with the key. In every individual case, the specific position of the teeth 4 is controlled by means of toothed wheels 5 which can be turned at will and are mounted on axles 6 established in the head 2 of the key.

As it can be observed in any of the figures, the wheels occupy a position which is very close to the beginning of the stem 1 and each one of them comprises pressure elements 7 which attack them radially, in order to achieve a perfectly defined and controlled step-by-step rotation for them.

Each pressure element consists in a stem 7 which is retractile against the tension of a spring 8, having play in the interior of a frame 9 provided with a support leg 10, through which the set is rigidized to the internal surface of frame 2 of the head of the key in its appropriate place.

In this already known structure and in accordance with the present invention, two racks 11 have been provided as transmission means between the toothed wheels 5 and the sets of teeth 4; these racks slide in the hollow interior of the key, precisely on guides 12, and are provided with toothings according to the toothed wheels 5, so that the latter would act as driving pinions for the racks.

As it has been said before, this wheel-rack transmission system forces the toothed wheels 5 to occupy an extreme position in the head 2, as close as possible to the beginning of the stem 1, so that the size of the key can be reduced to a minimum. It furthermore determines that the head 2 of the key presents a length at least coinciding with the one of the stem 1, as in the position of maximum retraction for the teeth 4 practically the entire length of the racks 11 must be housed in the interior of the head 2.

In the preferred embodiment shown in the figures, the guides 12 are materialized in two oblique wings forming a longitudinal groove of throttled inlet, but said guides may obviously adopt any other configuration, whenever they would assure a correct longitudinal sliding of the racks without any slippings.

Figure 2:
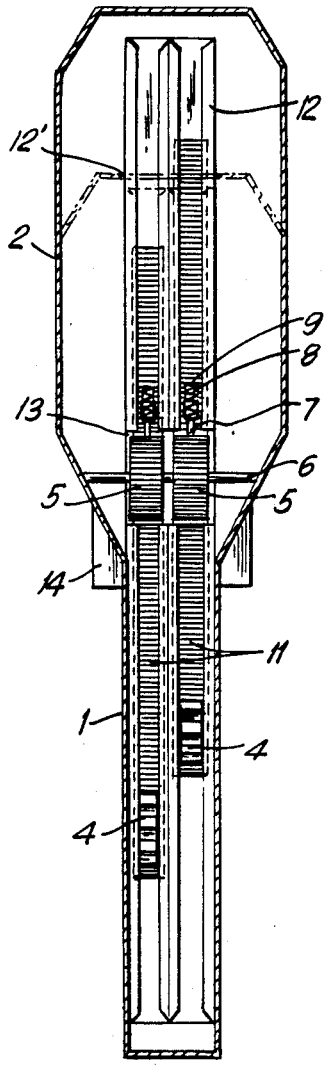
FIG. 2 is a plan view of the same key with its frame sectioned, clearly showing its interior structure.
Figure 3:
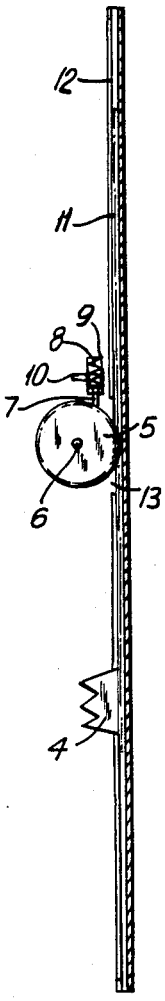
FIG. 3 is a profile of the means provided for the transmission from one of the actuating wheels to the corresponding set of teeth.
Figure 4:
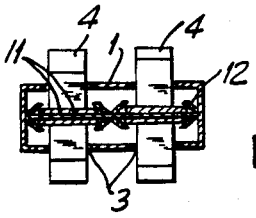
FIG. 4 is a cross section of the stem of the key, corresponding to a preferred embodiment, wherein two mobile and independent sets of teeth are incorporated on each side of the key, in accordance with the section line A–B of FIG. 1.

As it is shown in FIG. 2, guides 12 present gaps 13 at the level of the wheels 4, thereby assuring the correct coupling of these wheels on the whole width of the respective racks.

In accordance with another one of the objects of the invention, it has been arranged that the head 2 of the key presents some lateral flanges or wings 14 in its coupling zone to the stem, which are extended in a short sector of the very same stem and which are to be introduced in slots operatively worked in the tumbler of the lock. After introducing the key into the tumbler and setting the blocking lugs of the latter free on behalf of the teeth 4, the angular stress necessary to carry out the effective opening that is manually applied to the head of the key, is transmitted to the tumbler directly through the flanges 14. In this way, neither the stem 1 nor the teeth 4 suffer any torsional stress that, may mismatch the teeth.

As the heretofore exposed points show, the rigidity and direct fixing of the teeth 4 to the respective racks 11, the perfect coupling of racks 11 in their guides 12, and the also direct meshed engagement and adjustment of racks 11 with the toothed wheels 13, guarantee a maximum degree of precision, when the positional control of the teeth is undertaken which, at the same time, means a most perfect functionality of the key.

It has been said before that the head 2 of the key must have a length at least coinciding with the one of the stem 1, because in a position of maximum retraction for the teeth 4, practically the entire length of the racks 11 must be housed in the interior of the head. However, in accordance with the representation in a broken line of FIG. 2, there is also the possibility that the head 2 could be shorter; in this case the area of the head opposite to the stem 1 must have some holes or windows 12', through which the racks 11 can emerge to the outside, when a high retraction degree is required for the teeth 4. In this case the guides 12 are obviously interrupted at the level of the mouth of the holes which means that these guides are not extended to the outside of the head.

Figure 5:
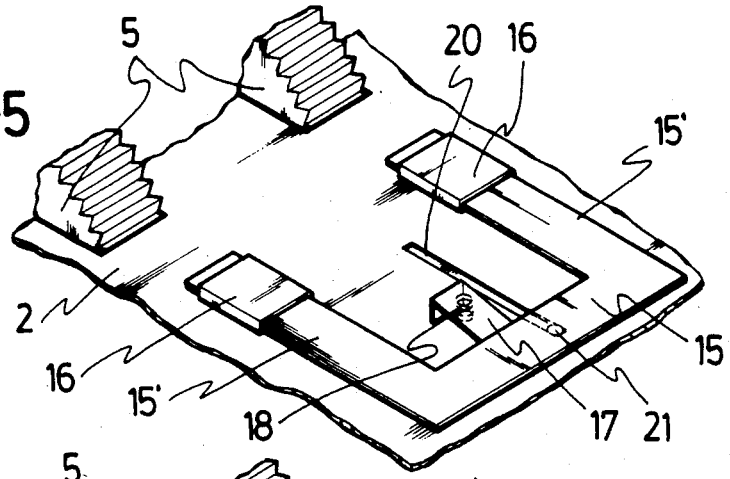
FIG. 5 is a perspective view of the enlarged head of the key which shows in detail the blocking mechanism for the control wheels of the teeth of the key, when it is in an inoperative position.
Figure 6:
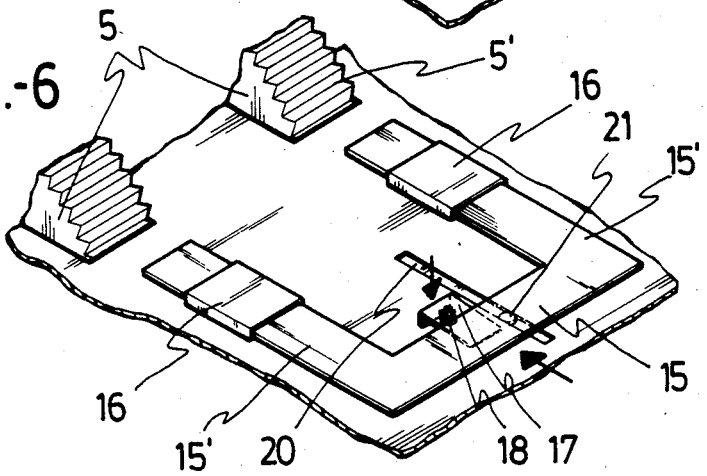
FIG. 6 is the same set-up of the previous figure in an intermediun stage of action.
Figure 7:
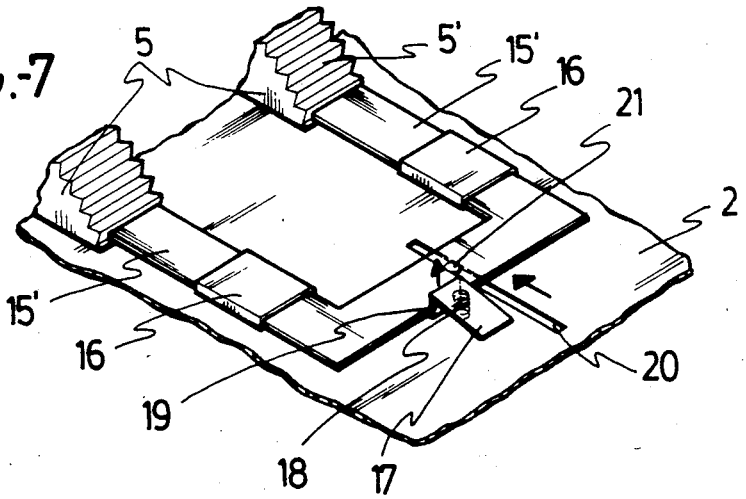
FIG. 7 is the same set-up of the two previous figures in a final or blocking stage.

In accordance with another one of the objects of the present invention (FIGS. 5 to 7), a blocking mechanism is incorporated in the key which makes impossible an accidental rotation of the control wheels 5 at the moment of introducing the key into the lock due to the insertion resistance determined by the latter.

More precisely speaking, the blocking mechanism is materialized in a "U" shaped slide 15 whose lateral branches 15', are spaced according to the separation between the control wheels 5 and are slidably disposed on guide bridges 16, so that the lateral branches 15' can adopt an inoperative position, (FIG. 7), in which their ends fit and are locked in the slots 5' of wheels 5, causing a rigid blocking of same.

To achieve a stable position of "U" shaped slide 15, it has been arranged that an inclined plane 17 is placed on the corresponding side of the head 2 of the key, this plane being retractile against the tension of a spring 18. Starting with the position shown in FIG. 5, upon pushing slide 15 in the sense of the arrow of FIG. 6, the middle section of the slide moves on the retractile plane 17, making it tip down. In the limit position shown in FIG. 7, "U" shaped slide 15 surpasses the retractile plane 17 and this one recovers by the effect of spring 18 and determines a retention stage 19 for the slide 15 in blocking position.

To set this mechanism free, one just has to push down plane 17, so that slide 15 can be freely moved away from the control wheels 5.

Finally, as a complement of this structure, a guide slot 20 has been provided on the head 2 of the key and a lug 21 has been provided on the lower side of slide 15. The lug 21 moves along the guide slot 20, so providing a perfect sliding of the slide 15 without any lateral slippings.

When there are three toothed wheels 5 established on one side of the key, there will obviously be three operative branches 15' of the slide 15 too and this mechanism is repeated on the opposite side of the key, when there are control wheel sets 5 on both sides of same.

I claim:

1. A combination key comprising a hollow head, a hollow stem connected to said head, a plurality of teeth mounted in said stem movable in longitudinal direction thereof, toothed control wheels mounted in said head so as to partially emerge to the outside, transmission means for transmitting the movement of said control wheels to said teeth, so that said teeth can be positioned to achieve the desired combination, said transmission means including racks extending in the longitudinal direction of said stem and longitudinally slidable in said stem and said head, said teeth attached to said racks, said racks being in meshed engagement with said toothed control wheels, guide members for guiding said racks within said stem, wherein said wheels are located in said head next adjacent said stem, and wherein the length of said head is at least equal to the length of said stem, so that said racks can be accommodated in said head when said teeth are in a position of maximum retraction.

2. A combination key comprising a hollow head, a hollow stem connected to said head, a plurality of teeth mounted in said stem movable in longitudinal direction thereof, toothed control wheels mounted in said head so as to partially emerge to the outside, transmission means for transmitting the movement of said control wheels to said teeth, so that said teeth can be positioned to achieve the desired combination, said transmission means including racks extending in the longitudinal direction of said stem and longitudinally slidable in said stem and said head, said teeth attached to said racks, said racks being in meshed engagement with said toothed control wheels, guide members for guiding said racks within said stem, wherein said wheels are located in said head next adjacent to said stem, and wherein the length of said head is smaller than the length of said stem, said head defining holes in alignment with said racks, so that said racks can be moved through said holes outside of said head when said teeth are in a position of maximum retraction.

3. The COMBINATION KEY according to claim 1 comprising, in its union area between head and stem a pair of lateral flanges or wings to be inserted in slots provided in the tumbler of the lock, to effect the transmission of the rotation stress applied to the head of the key, on opening or closing of the lock.

4. The COMBINATION KEY according to claim 1, wherein, a blocking mechanism is established in the body of the key, corresponding to each group of control wheels or elements, preferably in pairs and formed by a "U" shaped slide in the precise case of a key with two control wheels, in the lateral branches of said slide being spaced apart according to the separation between said wheels, so that their ends can be locked in the slots defined by the teeth of the wheels, to determine their blocking two bridges joined to the body having been provided to cooperate with said "U" slide in function of guides for their lateral branches, while a lower lug is established in the middle section of the slide to move along a slot of the body of the key, the whole set being displaced manually in alternative directions to unblock the control elements, as well as to cause their blocking, once the specific combination would have been chosen for the teeth.

5. The COMBINATION KEY according to claim 1, wherein a retractile, inclined plane appeares directly in the path of the middle section of the "U" slide when it advances towards the blocking position, sowith causing the retraction of said plane against the tension of the lower spring up to reaching the limit blocking position in which the middle section of the slide surpasses said plane which is then recovered by the effect of said spring and determines a retention top for the slide in such a blocking position.

* * * * *